US007536965B2

(12) United States Patent
Johnson

(10) Patent No.: US 7,536,965 B2
(45) Date of Patent: May 26, 2009

(54) AUXILIARY LIFT ATTACHMENT FOR A BOAT LIFT AND METHOD OF USING SAME

(76) Inventor: John F. Johnson, 1427 Shanandoad Pkwy., Chesapeake, VA (US) 23320

( * ) Notice: Subject to any disclaimer, the term of this patent is extended or adjusted under 35 U.S.C. 154(b) by 0 days.

(21) Appl. No.: 11/827,970

(22) Filed: Jul. 16, 2007

(65) Prior Publication Data

US 2009/0020057 A1 Jan. 22, 2009

(51) Int. Cl.
*B63C 7/00* (2006.01)

(52) U.S. Cl. ..... 114/44

(58) Field of Classification Search ..... 114/374, 114/44, 365–369; 405/3; 414/543, 678; 212/223, 306, 307, 245, 249
See application file for complete search history.

(56) References Cited

U.S. PATENT DOCUMENTS

| | | | | |
|---|---|---|---|---|
| 2,590,715 | A | 3/1952 | Linsmeier | |
| 3,804,263 | A | 4/1974 | Castonguay | |
| 3,836,024 | A * | 9/1974 | Mantino | 414/543 |
| 4,983,067 | A | 1/1991 | Montgomery | |
| 5,090,842 | A | 2/1992 | Montgomery | |
| 5,245,940 | A | 9/1993 | Rockwood | |
| 5,445,487 | A | 8/1995 | Koseinski | |
| 5,735,561 | A | 4/1998 | Perkins | |
| 5,752,799 | A * | 5/1998 | Carey et al. | 414/543 |
| 5,839,851 | A | 11/1998 | Norfolk | |
| 5,971,177 | A * | 10/1999 | Carter | 212/177 |
| 6,189,866 | B1 * | 2/2001 | Harkins et al. | 254/332 |
| 6,499,610 | B2 | 12/2002 | Spitsbergen | |
| 6,981,834 | B1 * | 1/2006 | Henry | 414/462 |
| 2004/0256607 | A1 | 12/2004 | Spitsbergen | |

FOREIGN PATENT DOCUMENTS

GB 2112737 A * 7/1983

* cited by examiner

*Primary Examiner*—Ed Swinehart
(74) *Attorney, Agent, or Firm*—William G. Sykes

(57) ABSTRACT

An attachment for use with a boat lift that both lifts the watercraft out of the water and allows horizontal movement of the watercraft to a position over a dock. The apparatus provides a vertical extension to the central mast of the lift apparatus. A horizontal arm attached to the distal end of the vertical extension provides an attachment point for a cable, which may be connected to the watercraft while still afloat. Raising the mast raises the suspended watercraft above the water while a cradle assembly upon which the hull of the watercraft normally rests is disposed a predetermined distance below the hull. Once the hull is raised above the dock, the vertical mast rotates to position the watercraft over the dock. The cradle is positioned underneath the dock. The watercraft may be lowered onto the dock with no intermediate structure between the hull and the dock surface.

2 Claims, 8 Drawing Sheets

AUXILIARY LIFT ATTACHMENT FOR A BOAT LIFT AND METHOD OF USING SAME

FIELD OF THE INVENTION

The invention pertains to boat lifts, and more specifically, to an auxiliary lift attachment for use with a swinging style boat lift for small watercraft.

BACKGROUND OF THE INVENTION

Personal watercraft are small, self-propelled boats that are typically used by only one or two people. One such type of personal watercraft is referred to as a Jet Ski®. While Jet Ski® is a registered trademark for personal watercraft manufactured by Kawasaki Heavy Industries, Ltd., the term has become a genericized trademark for such watercraft. Jet Ski®-type watercraft are propelled by jets of rearwardly-ejected, pressurized water. When a Jet Ski® is not in use, it is desirable that it be stored out of the water. Because a water pump and/or impeller of a Jet Ski® can pick up debris when the Jet Ski® is parked on a beach, it is desirable to store a Jet Ski® on a dock or in a cradle above the water.

Because a Jet Ski® may be heavy, typically weighing several hundred pounds, lifting one out of the water after use is not a trivial task. Consequently, a lifting apparatus is often provided to lift the Jet Ski® above the water surface, and in some cases, onto a dock. The same lifting apparatus may, of course, be used to reinsert the Jet Ski® into the water when the watercraft is again to be used.

Unlike some small watercraft, personal watercraft (e.g., Jet Skis®) are extremely heavy. Also, because they include an engine and other mechanical components, they occasionally require service. While larger boats typically may be serviced in the water, Jet Skis® are too small to allow a mechanic or other service person to climb on board to perform some types of service. Consequently, at least some service operations are best performed on a Jet Ski® out of the water and, more specifically, with the Jet Ski® resting on a dock or other surface.

Boat lifts are well known in the prior art and are widely used to raise watercraft of all sizes out of the water. However, most known lifts simply raise the watercraft above the water surface but are incapable of moving the load (i.e., the watercraft) onto a dock. This is disadvantageous because Jet Skis® must be removed from the lift to be serviced or stored. Because Jet Skis® are heavy, they are difficult to move horizontally from a position out over the water onto the dock. Furthermore, servicing the Jet Ski® while it is located out over the water on a prior art boat lift is clumsy and difficult as the technician typically must lean out from the dock over the water.

DISCUSSION OF THE RELATED ART

Several attempts have been made to overcome this problem of moving a personal watercraft from suspension in the water onto a dock. For example, U.S. Pat. No. 4,983,067 for BOAT LIFT APPARATUS, issued Jan. 8, 1991 to David M. Montgomery, discloses a lift apparatus for personal watercraft. The disclosure provides a cradle suitable for supporting the watercraft. The cradle may be raised or lowered to insert or withdraw a personal watercraft into or from the water. When withdrawing the personal watercraft from the water, once the cradle is raised above the level of the deck to which the lift apparatus is attached, the cradle may be rotated around a support post and brought to rest on the surface of the dock.

U.S. Pat. No. 5,090,842 for BOAT LIFT APPARATUS AND SYSTEM, issued Feb. 25, 1992 to David M. Montgomery, provides a lift apparatus structurally similar to the lift disclosed in the MONTGOMERY '067 patent discussed hereinabove. However, the cradle of the '067 patent is replaced by a wheeled dolly having rails to accommodate the keel of a personal watercraft. Once the personal watercraft is withdrawn from the water and the lift pivoted onto the deck, the dolly carrying the personal watercraft may be wheeled away.

U.S. Pat. No. 5,245,940 for LOAD LIFTING DEVICE, issued Sep. 21, 1993 to Joseph C. Rockwood, provides another lift for a personal watercraft wherein a cradle supporting the watercraft may be rotated onto a dock once the watercraft is raised above the water.

U.S. Pat. No. 5,839,851 for PERSONAL WATERCRAFT LIFT, issued Nov. 24, 1998 to Lynn P. Norfolk et al., teaches yet another lift for a personal watercraft wherein a cradle supporting the watercraft may be rotated onto the dock once the watercraft is raised above the water.

The lifts described in these United States patent all suffer from one major disadvantage: the personal watercraft is still supported on the cradle once the lift is rotated onto the dock. This generally makes further manipulation of the watercraft difficult, as it must still be manually lifted for transportation, storage, or service.

It is, therefore, desirable to have a boat lift apparatus that raises the load out of the water to a desired vertical height; moves the load horizontally to a position over the dock; and suspends the watercraft above the dock with no intervening structure (e.g., a cradle).

None of these patents, taken singly or in combination, are seen to anticipate or suggest the lift attachment and method of the present invention.

SUMMARY OF THE INVENTION

In accordance with the present invention, there is provided an attachment for use with a personal watercraft lift apparatus designed to both lift the boat out of the water and to horizontally move the watercraft to a position over a dock. The apparatus of the present invention provides a vertical extension to a central mast of an existing lift apparatus. A horizontal arm attached to the upper, distal end of the vertical extension provides an attachment point for a rope, cable, chain, etc. Before the watercraft is raised above the water and moved horizontally to a position over the dock surface, a cable is secured to the watercraft and to one or more attachment points on the horizontal arm. When the mast of the lift is raised, the watercraft is suspended from the cable(s), not by the normal cradle located at the lower end of the mast. Once clear of the upper surface of the dock, the mast may be rotated thereby moving the suspended watercraft horizontally to a point above the dock's upper surface. However, the cradle normally supporting the watercraft during lifting with a conventional lift of the prior art is beneath the dock leaving no intervening structure between the hull of the watercraft and the dock surface.

It is, therefore, an object of the invention to provide an attachment for a lifting apparatus for a personal watercraft, for example a Jet Ski®.

It is another object of the invention to provide an attachment to a lifting apparatus for a personal watercraft whereby the personal watercraft may be suspended therefrom.

It is an additional object of the invention to provide an attachment to a lifting apparatus for a personal watercraft that allows the lift cradle to be positioned under the dock while the suspended watercraft is on or above the dock's upper surface.

It is a further object of the invention to provide an attachment to a lifting apparatus for a personal watercraft wherein the vertical extension may be adjustably affixed to a personal watercraft lift.

It is a still further object of the invention to provide an attachment to a lifting apparatus for a personal watercraft wherein multiple attachment points may be provided along a horizontal arm to allow selectability in suspending personal watercraft of various dimensions and/or shapes.

It is yet another object of the invention to provide an attachment to a lifting apparatus for a personal watercraft that is inexpensive, easy to use, and accommodates personal watercraft of a wide range of sizes and shapes.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

The present invention provides a device for attachment to a lifting apparatus for a personal watercraft to extend the functionality thereof.

Figure 1:
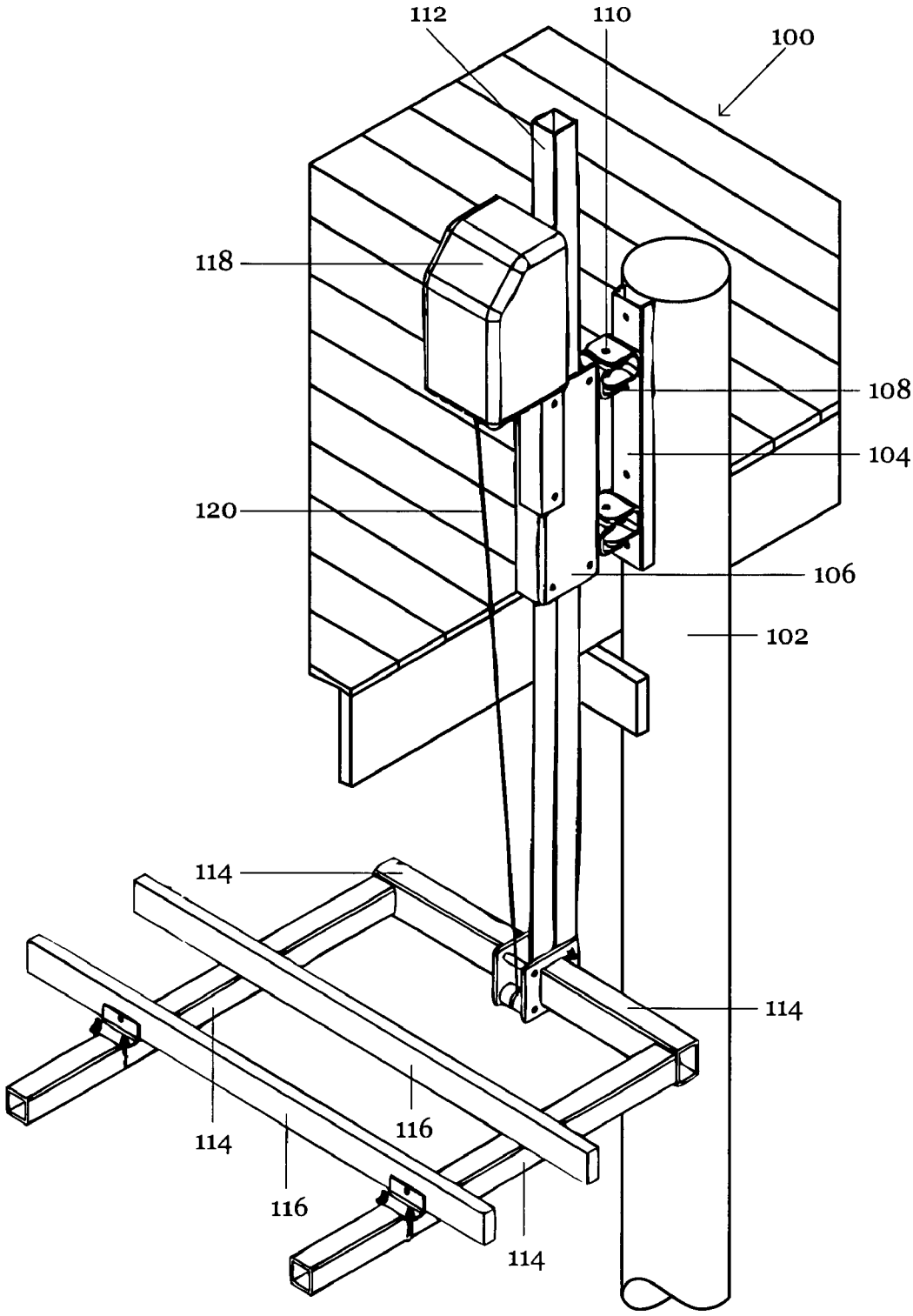
Fig. 1 (Prior Art)
FIG. 1 is a schematic, perspective view of a personal watercraft lift of the prior art suitable for use with the apparatus of the invention.

Referring first to FIG. 1, there is shown a schematic, perspective view of a typical personal watercraft lift of the prior art, generally at reference number 100. A "Swinger" lift supplied by Davit Master Corporation of Clearwater, Fla. USA has been found suitable for use with the attachment of the invention. However, it should be recognized that the inventive attachment may be used with any similar boat lift system.

A piling 102 supports a piling mount 104 rigidly affixed thereto. Piling mount 104 rotatively supports housing 106 on swivel bushings 108 and is affixed thereto by pins 110.

A vertical mast 112 is slidably movable within housing 106. Vertical mast 112 is typically formed from square, galvanized steel tubing.

Cradle arms 114 are suitably affixed to the lower, distal end of vertical mast 112. Cradle arms 114 support bunk boards 116 that are positioned to receive a hull of a personal watercraft 400 (FIG. 4) thereupon.

A bi-directional electric winch 118 is also attached to housing 106. A cable 120 extends from a lower region of electric winch 118. A distal end of winch cable 120 is attached to cradle arms 114 proximate the distal end of vertical mast 112. Electric winch 118 raises and lowers vertical mast 112 via winch cable 120 in a manner well known to those of skill in the art. It will be recognized that manually-operated boat lifts, not shown, may also be used with the attachment of the present invention.

Prior art boat lifts such as boat lift 100 used for purposes of disclosure are believed to be well known to those of skill in the art. Consequently, boat lift 100 is not further described herein. Other than supporting the attachment of the present invention, boat lift 100 forms no part of the invention.

Figure 2A:
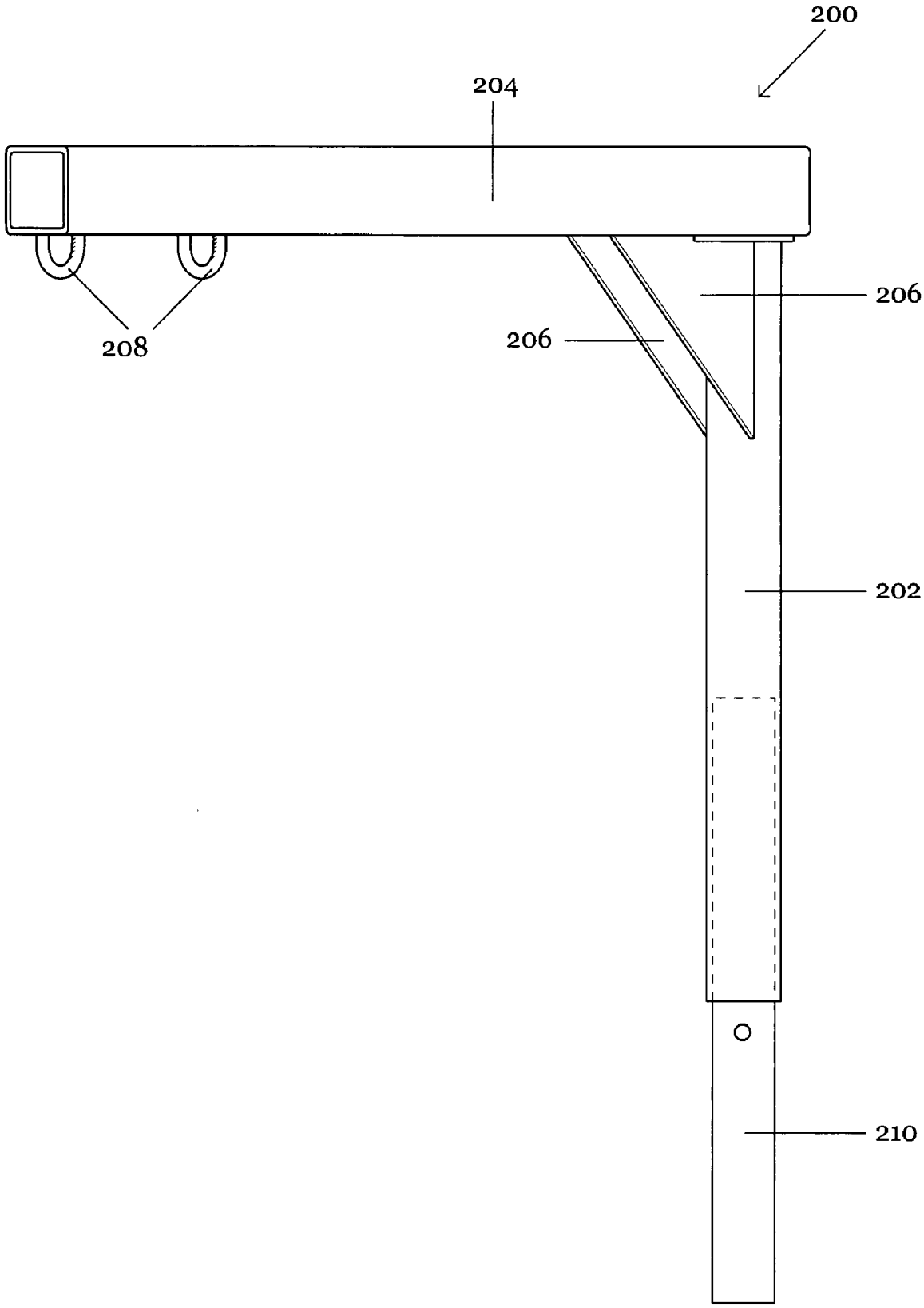
FIG. 2*a* is a schematic perspective view of one embodiment of the lift attachment in accordance with the present invention.

Referring now to FIG. 2*a*, there is shown a side, perspective view of the attachment of the present invention, generally at reference number 200. A mast extension 202, typically formed from square steel tubing, has both an outside and an inside diameter similar to the respective dimensions of vertical mast 112 (FIG. 1). A mast coupling member 210, also typically formed from square steel tubing, has an outside diameter selected to fit within mast extension 202. Typically a snug fit is desired. Mast coupling member 210 is secured within mast extension 202 by swaging, cementing, and/or welding, through fastening, or any other similar process. Mast coupling member 210 protrudes beyond the lower, proximal end of mast extension 202. It will be recognized that mast extension 202 and/or mast coupling member 210 may be formed from other suitable materials and may also have shapes other than squares to allow attachment to a vertical mast 112 of the particular boat lift 100 (FIG. 1) with which attachment 200 is to be used. It will further be recognized that other design possibilities exist and are believed to be known to those of skill in the art for connecting mast extension 202 to vertical mast 112 of boat lift 100. Consequently, the invention is not limited to the coupling method chosen for purposes of disclosure. Rather, the invention includes any suitable coupling method.

A horizontal arm 204 is affixed to the upper, distal end of mast extension 202 using any suitable technique. In the embodiment chosen for purposes of disclosure, mast extension 202 is welded to horizontal arm 204. It will be recognized that other techniques for joining mast extension 202 and horizontal arm 204 may be used. Consequently, the invention is not limited to the welded joint chosen for purposes of disclosure. Rather the invention includes any and all suitable joining techniques. Regardless of the joining method used, mast extension 202 is substantially coaxially aligned with mast 112.

One or more gusset plates 206 or other suitable bracing members may be provided to help support horizontal arm 204 on mast extension 202.

One or more eye bolts 208 or other suitable fasteners may be disposed along horizontal arm 204, typically towards the distal end thereof.

Figure 2B:
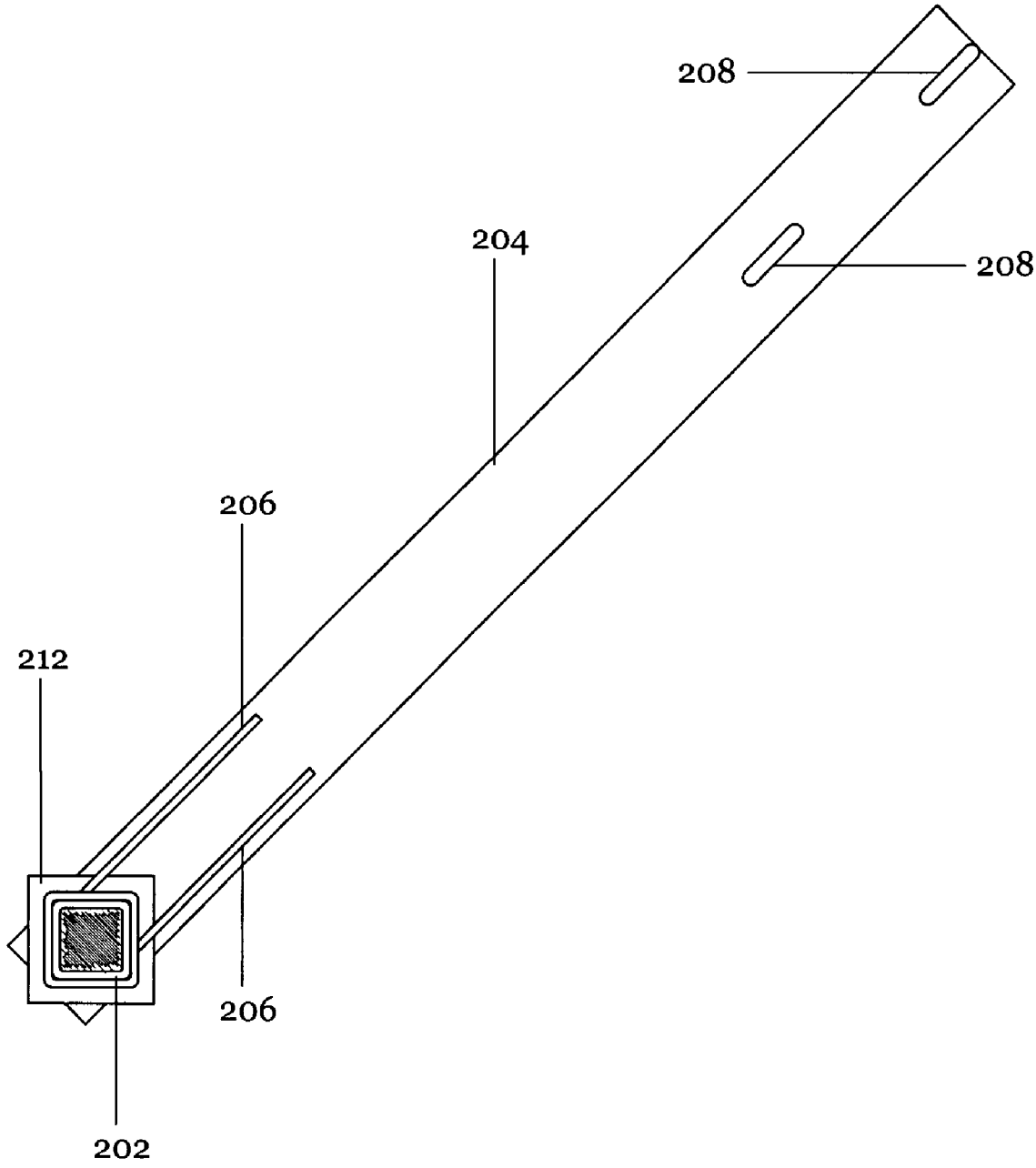
FIG. 2*b* is a bottom plan, schematic view of the lift attachment of FIG. 2*a;*

Referring now also to FIG. 2*b*, there is shown a bottom plan, schematic view of the attachment apparatus of FIG. 2*a*. As may be seen, horizontal arm 204 is positioned at an acute angle to any face of mast extension 202. A plate 212 may be secured between mast extension 202 and horizontal arm 204 to both facilitate the attachment of horizontal arm 204 to mast extension 202 as well as to distribute stresses transmitted from horizontal arm 204 to mast extension 202.

Figure 3:
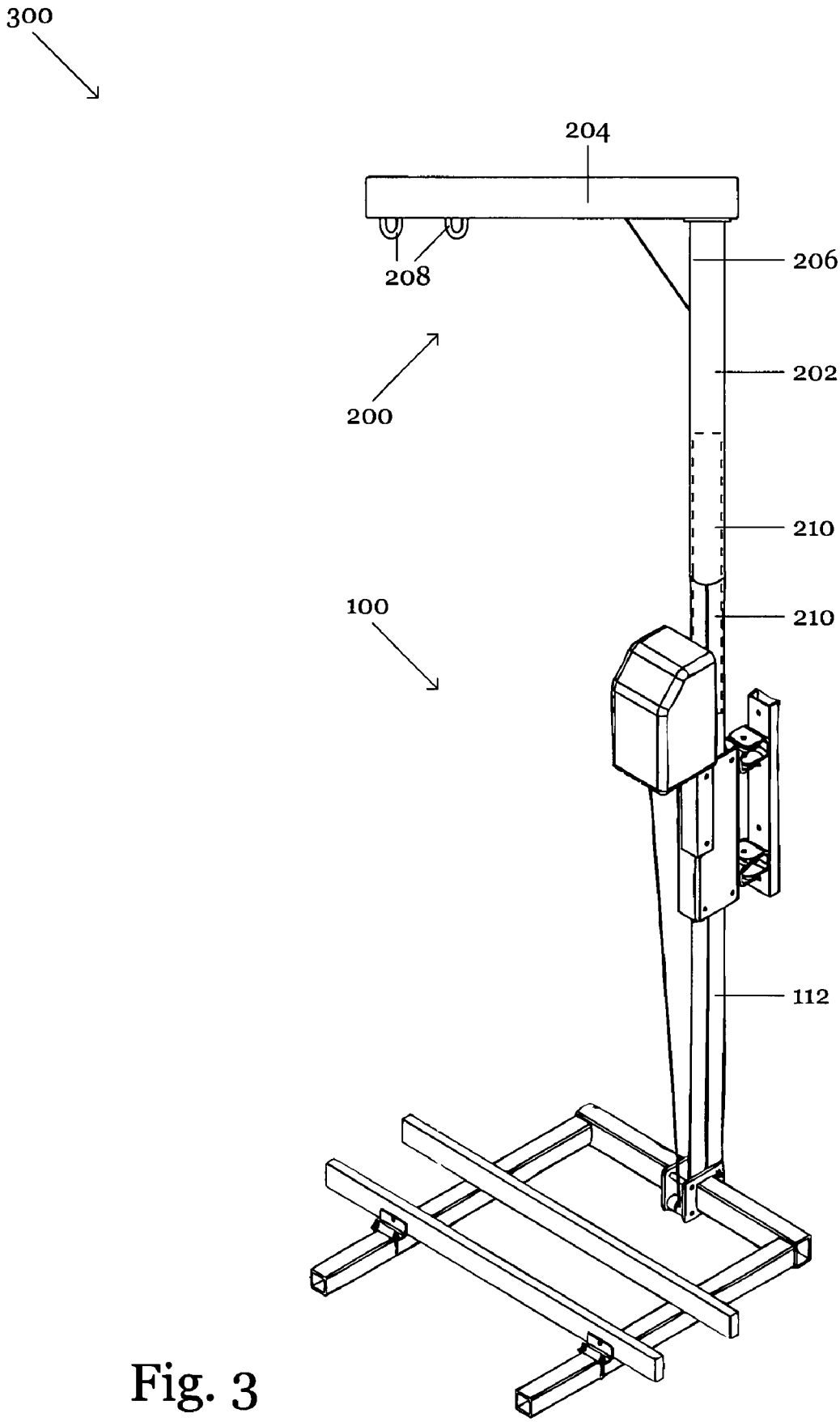
FIG. 3 is a schematic, perspective view of the prior art lift of FIG. 1 with the attachment of FIGS. 2*a* and 2*b* installed thereupon.

Referring now also to FIG. 3, there is shown a schematic, perspective view of boat lift 100 with the novel attachment 200 installed thereupon, generally at reference number 300. Mast coupling member 210 is inserted into an upper, proximal end of vertical mast 112, thereby securing assembly 200 to boat lift 100.

Figure 4A:
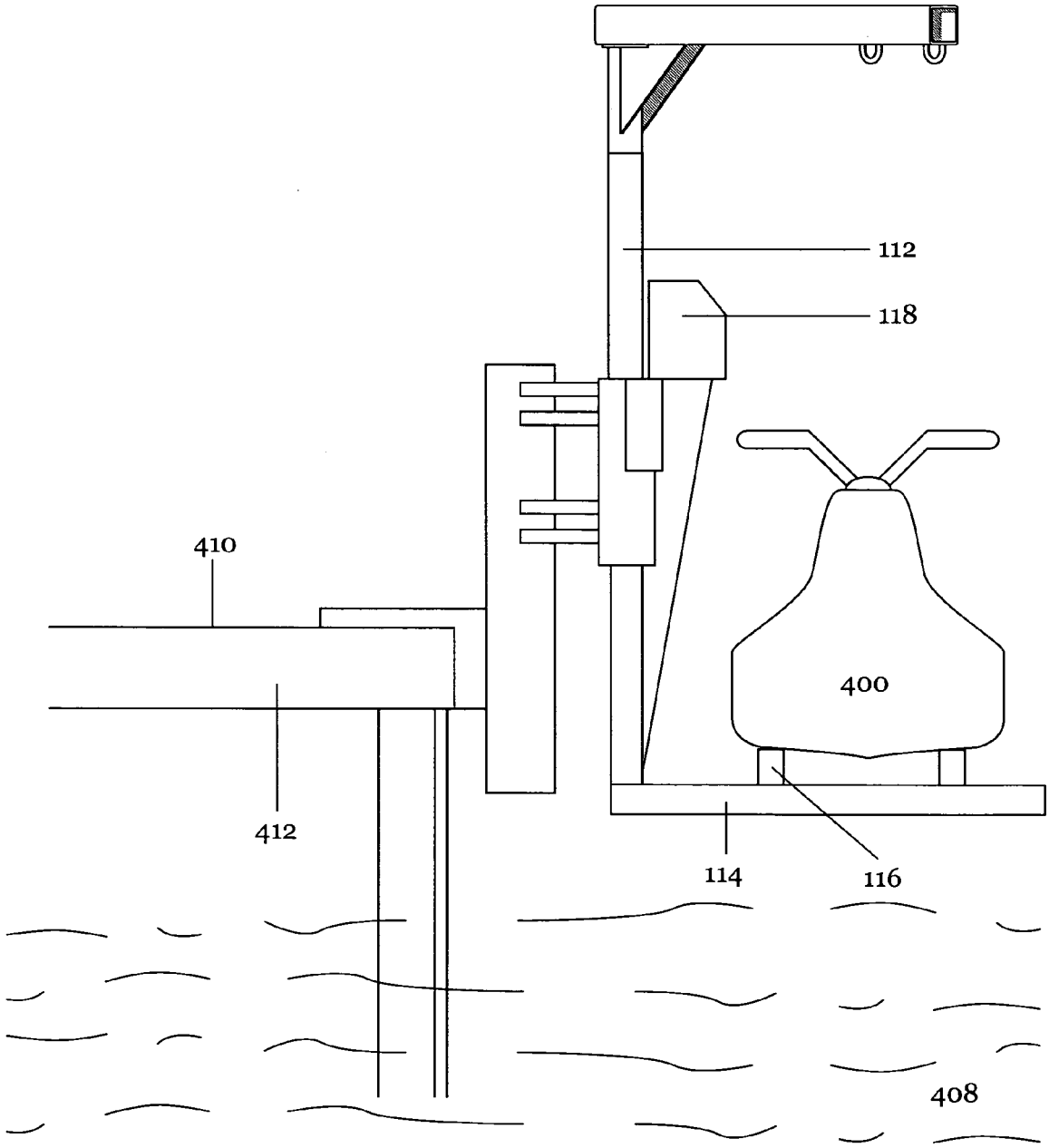
FIG. 4*a* is a side elevational view of a dock with the lift of FIG. 1 and the attachment of FIGS. 2*a* and 2*b* attached thereto, the attachment of FIGS. 2*a* and 2*b* is not connected to a watercraft and the lift operates in the manner of the prior art.

Referring now to FIG. 4*a*, there is shown a side elevational view illustrating the operation of boat lift 100 in a conventional manner. Auxiliary apparatus 200 of the invention is attached to boat lift 100, but is not in use. A personal watercraft 400 is shown disposed on bunk boards 116 supported on cradle arms 114.

In conventional operation, watercraft 400 is afloat and is positioned over cradle arms 114 and bunk boards 116. Once positioned, bi-directional electric winch 118 is operated to raise cradle arms 114 carrying bunk boards 116 against the bottom of the hull of watercraft 400. Continued operation of electric winch 118 raises watercraft 400 out of the water to a position as shown in FIG. 4*a*.

Figure 5A:
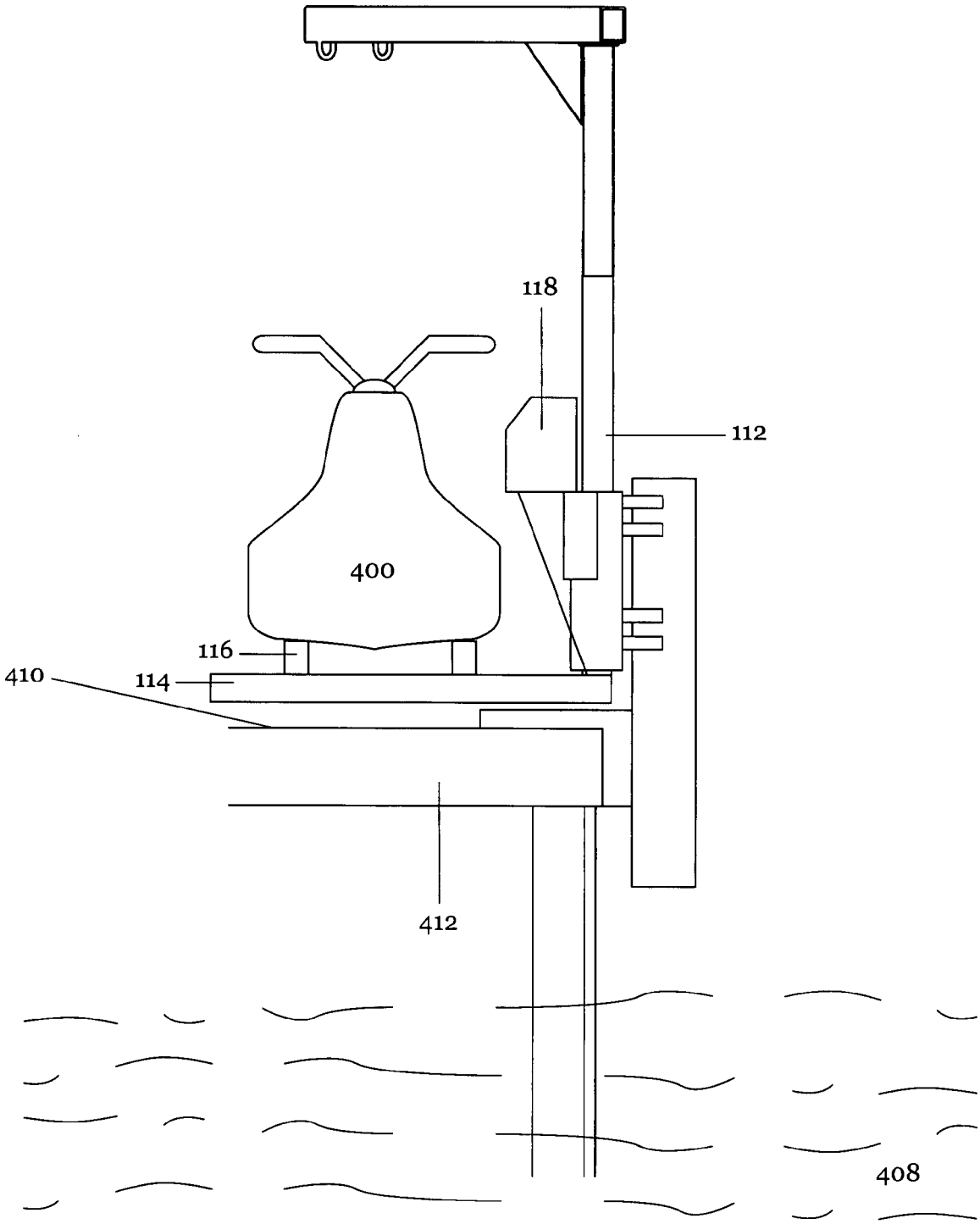
Fig. 5a (Prior Art)
FIG. 5*a* is a side elevational view of a dock with the lift of FIG. 1 and the attachment of FIGS. 2*a* and 2*b* attached thereto, the attachment of FIGS. 2*a* and 2*b* is not connected to a watercraft and the lift operates in the manner of the prior art and the personal watercraft supported over the dock.
Figure 5B:
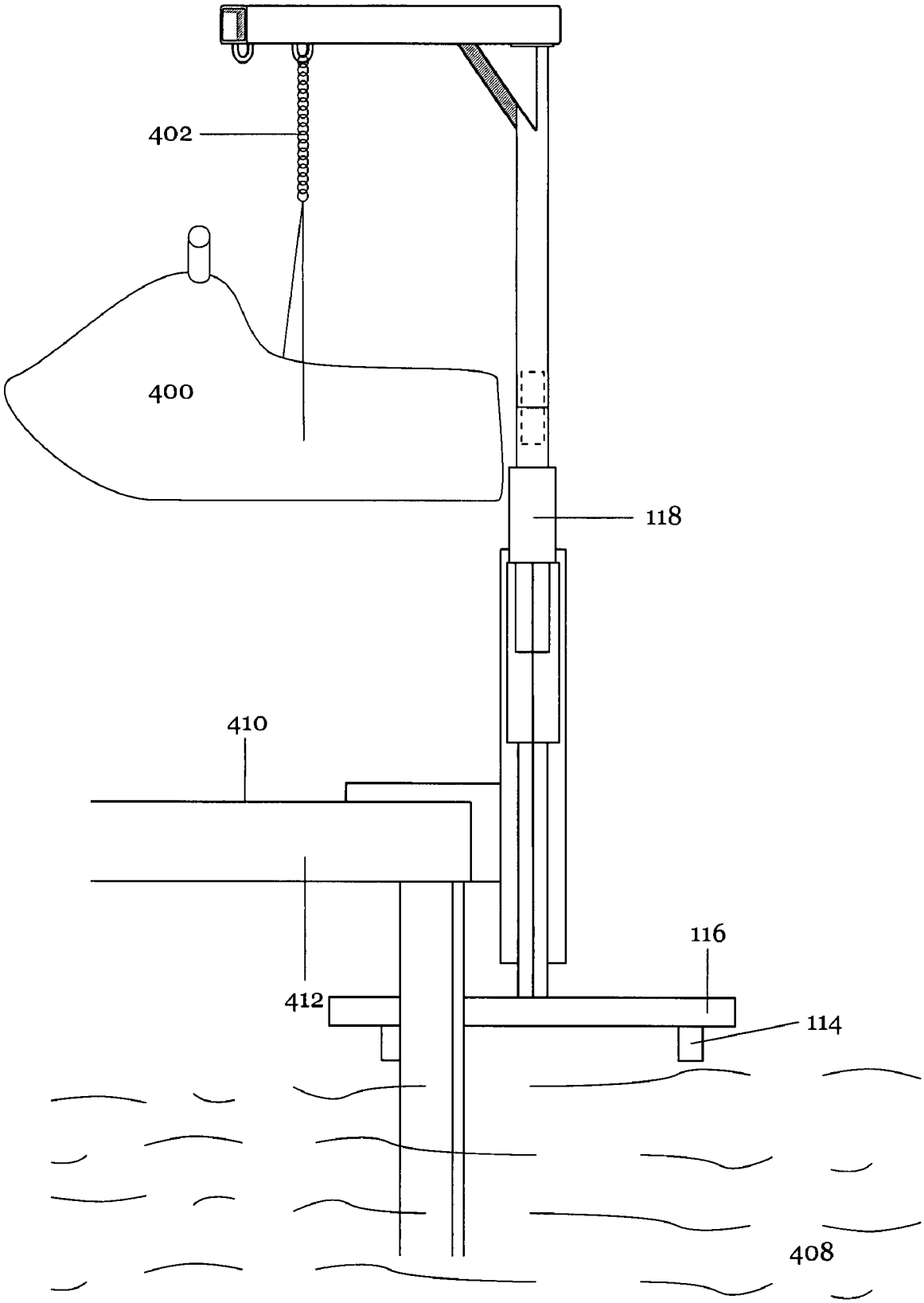
FIG. 5*b* is a side elevational view of a dock with the lift of FIG. 1 and the attachment of FIGS. 2*a* and 2*b* attached thereto, the personal watercraft being supported over the dock with no intervening structure therebetween in accordance with the present invention.

Continued operation of electric winch 118 eventually raises watercraft 400 and cradle arms 114 to a height above a top surface 410 of dock 412. Once this elevation is obtained, vertical mast 112 may be rotated, thereby positioning watercraft 400, still resting on cradle arms 114 and bunk boards 116, over surface 410 of dock 412. This position is shown in FIG. 5*a*. Electric winch 118 may then lower cradle arm 114 to rest on upper surface 410.

Figure 4B:
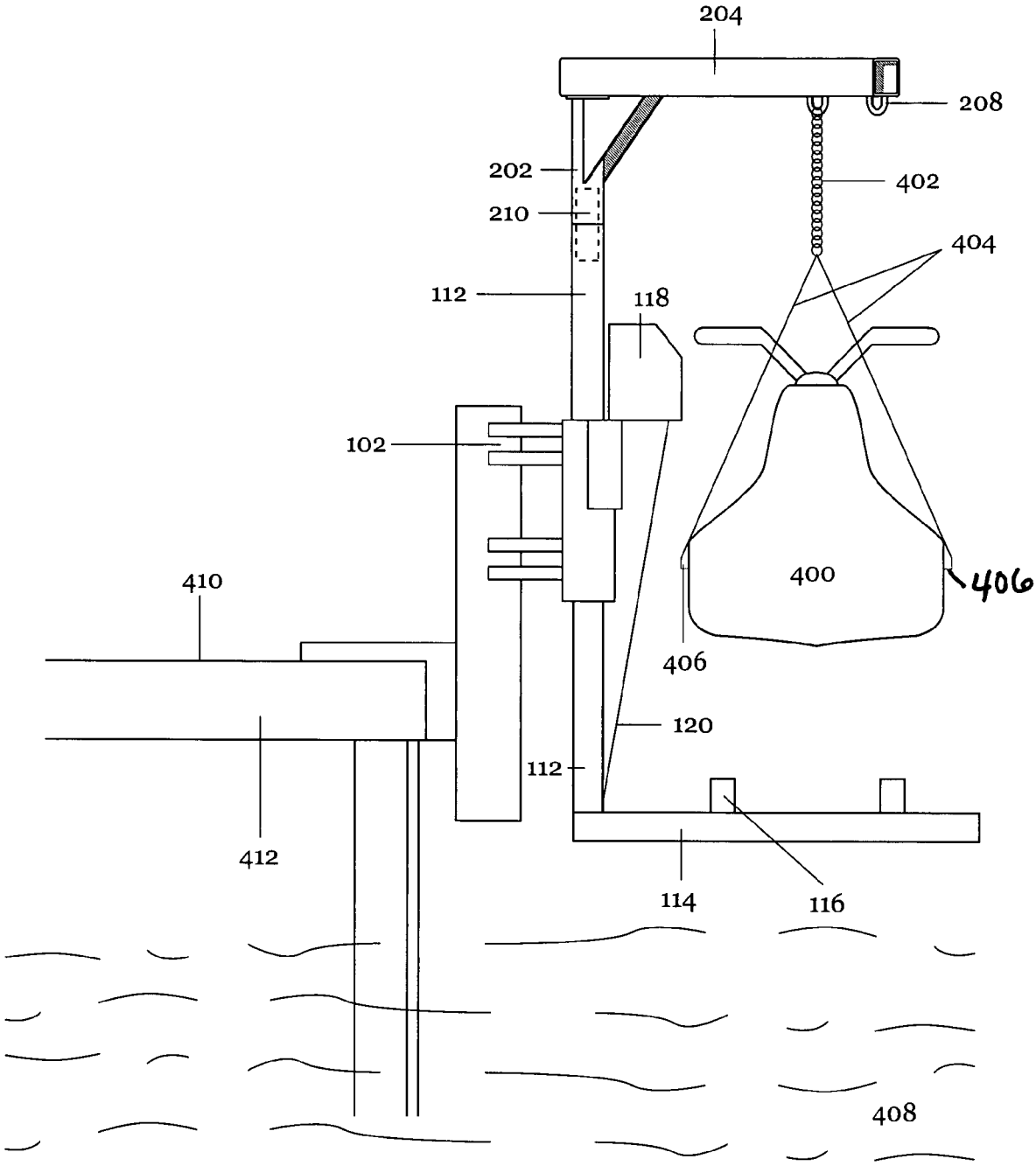
FIG. 4*b* is a side elevational view of a dock with the lift of FIG. 1 and the attachment of FIGS. 2*a* and 2*b* attached thereto and operatively attached to a personal watercraft supported over the water in accordance with the method of the invention.

Operation of boat lift 100 with novel auxiliary apparatus 200 is now described. Referring now to FIG. 4*b*, there is shown a side elevational view of boat lift 100 and auxiliary apparatus 200 operated in the novel manner of the present invention.

A cable, chain, rope, or other similar member 402 has a distal end affixed to eye bolt 208 in horizontal arm 204. As used herein, the term "cable" is intended to include any elongated, flexible member suitable for supporting watercraft 400 as is described hereinbelow. A plurality of cables 404 (only two shown for sake of simplicity) extend from a lower, proximal end of cable 402 to attachment points 406 on watercraft 400. In alternate embodiments, a sling, not shown, could be constructed around the hull of watercraft 400 to support watercraft 400.

In operation, while watercraft 400 is afloat and cradle arms 114 are below the hull bottom, cable members 402 and 404 are attached to horizontal arm 204 and attachment points 406 as previously described.

Once cable members 402, 406 are in place, electric winch 118 is activated to raise vertical mast 112 with auxiliary lift apparatus 200 affixed thereto. Watercraft 400 is supported by cable members 402, 404 and not by bunker boards 116 supported on cradle arms 114. By properly selecting lengths of cable members 402, 404, a relationship between the bottom of the hull of watercraft 400 and bunker boards 116 may be established such that when the hull of watercraft 400 is above upper surface 410 of dock 412, cradle arms 114 and bunker boards 116 are beneath any interfering member, not shown, of dock 412. Rotation of vertical mast 112 now positions watercraft 400 above surface 410 of dock 412 while cradle arms 114 and bunker boards 116 are beneath dock 412.

When electric winch 118 is lowered, watercraft 400 is positioned directly on surface 412 of dock 410 with no intervening structure. Maintenance may then be performed on watercraft 400. Alternately, watercraft 400 may be lowered onto a waiting dolly or similar structure, neither shown, for movement on dock 412.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A method for removing a watercraft from the water and depositing said watercraft on an upper surface of a dock with no intervening structure therebeneath, the steps comprising:

a) providing a boat lift having a hollow vertical mast rotatable about a fixed, central support, said vertical mast having a cradle assembly affixed at a lower, distal end thereof adapted to receive upon and support said watercraft, said vertical mast being selectively movable between a lower position wherein said watercraft is immersed at a floatable depth in water and an upper position wherein said watercraft is elevated above the surface of both said water and of a dock proximate said boat lift assembly;

b) installing an auxiliary lift assembly comprising a mast extension, a horizontal arm, and means for securing a cable disposed on said horizontal arm to an upper, proximal end of said vertical mast;

c) attaching at least one cable to said means for securing a cable and to a watercraft while said watercraft is afloat and said cradle assembly is disposed at least a predetermined distance below a hull of said watercraft;

d) vertically moving said vertical mast from a position whereat said cradle assembly is disposed at least a predetermined distance below said hull of said watercraft to a position where said hull is above an upper surface of a dock adjacent said boat lift and said cradle assembly is at a level lower than a bottom of said dock; and e) pivoting said vertical mast and said auxiliary lift assembly so that said watercraft is positioned over said upper surface of said dock and said cradle assembly is disposed beneath said dock.

2. The method for removing a watercraft from the water and depositing said watercraft on an upper surface of a dock as recited in claim 1, the steps further comprising:

f) lowering said vertical until said hull of said watercraft is resting on said upper surface of said dock with no intervening structure.

* * * * *